US009222435B2

(12) United States Patent
Komori et al.

(10) Patent No.: US 9,222,435 B2
(45) Date of Patent: Dec. 29, 2015

(54) STIRLING ENGINE WITH HUMIDITY CONTROL

(75) Inventors: Satoshi Komori, Susono (JP); Masaaki Katayama, Susono (JP); Manabu Tateno, Shizuoka-ken (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 0 days.

(21) Appl. No.: 13/579,652

(22) PCT Filed: Nov. 2, 2011

(86) PCT No.: PCT/JP2011/075314

§ 371 (c)(1),
(2), (4) Date: Aug. 17, 2012

(87) PCT Pub. No.: WO2013/065148

PCT Pub. Date: May 10, 2013

(65) Prior Publication Data

US 2014/0230428 A1 Aug. 21, 2014

(51) Int. Cl.

| | |
|---|---|
| ***F02G 1/043*** | (2006.01) |
| ***F02G 1/047*** | (2006.01) |
| ***F02G 1/06*** | (2006.01) |
| ***F02G 1/045*** | (2006.01) |

(52) U.S. Cl.

CPC ..... *F02G 1/0435* (2013.01); *F02G 1/045* (2013.01); *F02G 1/047* (2013.01); *F02G 1/06* (2013.01); *F02G 2244/08* (2013.01)

(58) Field of Classification Search

CPC ..... F02G 1/045; F02G 1/047; F02G 1/055; F02G 1/06; F02G 1/043; F02G 1/0435; F02G 2244/08

USPC ..... 60/517, 524

See application file for complete search history.

(56) References Cited

U.S. PATENT DOCUMENTS

| | | | | |
|---|---|---|---|---|
| 2,643,509 | A * | 6/1953 | Van Heeckeren | 60/524 |
| 4,387,568 | A * | 6/1983 | Dineen | 60/520 |
| 4,881,372 | A * | 11/1989 | Naito | 60/521 |
| 4,969,333 | A * | 11/1990 | Osawa et al. | 62/6 |
| 5,987,886 | A * | 11/1999 | Sekiya et al. | 60/523 |
| 2004/0154297 | A1* | 8/2004 | Strimling et al. | 60/517 |
| 2007/0277521 | A1* | 12/2007 | Tanaka | 60/517 |
| 2008/0163620 | A1* | 7/2008 | Yaguchi et al. | 60/517 |
| 2011/0232276 | A1* | 9/2011 | Yaguchi et al. | 60/517 |

FOREIGN PATENT DOCUMENTS

| | | | |
|---|---|---|---|
| JP | 5-172058 | | 7/1993 |
| JP | 9-264192 | | 10/1997 |
| JP | 2001153478 | A * | 6/2001 |
| JP | 2003294333 | A * | 10/2003 |

(Continued)

*Primary Examiner* — Thomas Denion
*Assistant Examiner* — Xiaoting Hu
(74) *Attorney, Agent, or Firm* — Finnegan, Henderson, Farabow, Garrett & Dunner, LLP

(57) ABSTRACT

A stirling engine 10A includes: cylinders 22 and 32; pistons 21 and 31, gas lubrication being performed between the corresponding cylinders 22 and 32 and the pistons 21 and 31; a crankcase 62 that is provided with a crankshaft 61 converting a reciprocating movement of the pistons 21 and 31 into a rotational movement; and a cooler 45 that cools a working fluid performing expansion work, wherein a start timing is adjusted based on an internal humidity of the crankcase 62.

7 Claims, 13 Drawing Sheets

(56) References Cited

FOREIGN PATENT DOCUMENTS

| | | |
|---|---|---|
| JP | 2005-113719 | 4/2005 |
| JP | 2008-267258 | 11/2008 |
| JP | 2009-91959 | 4/2009 |
| JP | 2010-222992 | 10/2010 |
| JP | 2011-74853 | 4/2011 |
| JP | 2011-99384 | 5/2011 |
| JP | 2011-149385 | 8/2011 |
| JP | 2011-202612 | 10/2011 |

* cited by examiner

STIRLING ENGINE WITH HUMIDITY CONTROL

CROSS-REFERENCE TO RELATED APPLICATIONS

This application is a national phase application of International Application No. PCT/JP2011/075314, filed Nov. 2, 2011, the content of which is incorporated herein by reference.

TECHNICAL FIELD

The present invention relates to a stirling engine.

BACKGROUND ART

There is known a stirling engine provided with a piston for gas lubrication between the piston and a cylinder (for example, see Patent Document 1). Further, for example, Patent Document 2 discloses a technique which may be relevant to the present invention, as there is provided with a moisture absorption device. Furthermore, for example, Patent Document 2 discloses technique which may be relevant to the present invention, as there is provided with a hygrometer.

PRIOR ART DOCUMENT

Patent Document

[Patent Document 1] Japanese Patent Application Publication No. 2010-222992

[Patent Document 2] Japanese Patent Application Publication No. 9-264192

[Patent Document 3] Japanese Patent Application Publication No. 5-172058

SUMMARY OF THE INVENTION

Problems to be Solved by the Invention

In a case where a cycle is established in the stirling engine, a cooler can cool working fluid which performs an expansion work. However, when the cooler cools the working fluid which has not sufficiently received heat, moisture contained in the working fluid might condense, so that condensation might occur. As a result, in the stirling engine provided with the piston and the cylinder between which the gas lubrication is performed, condensed water might infiltrate between the piston and the cylinder to disturb the gas lubrication.

Therefore, the present invention has been made in view of the above circumstances and has an object to provide a stirling engine which is provided with a piston for gas lubrication between the piston and a cylinder, and which is capable of improving disturbance of the gas lubrication by condensed water.

Means for Solving the Problems

The present invention is a stirling engine including: a cylinder; a piston, gas lubrication being performed between the cylinder and the piston; a crankcase that is provided with a crankshaft converting a reciprocating movement of the piston into a rotational movement; and a cooler that cools a working fluid performing expansion work, wherein a start timing is adjusted based on an internal humidity.

In the present invention, the start timing may be adjusted based on the internal humidity in a predetermined portion, and start may be performed when the internal humidity in the predetermined portion is lower than a predetermined value.

The present invention may further include a dehumidifying portion that reduces the internal humidity.

The present invention may further include a cooling portion that is capable of reducing a temperature of the working fluid to be lower than a temperature of the working fluid cooled by the cooler, and that is provided within the crankcase.

In the present invention, the cooling portion may operate based on a humidity within the crankcase.

The present invention may include a partition wall portion provided around the cooling portion within the crankcase.

In the present invention, a working fluid may be cooled by exchanging heat between the cooler and a cooling medium, a control valve may be further provided, may be capable of controlling supply of the cooling medium to the cooler, and may be controlled to restrict circulation of the cooling medium before start.

Effects of the Invention

According to an aspect of the present invention, in a case of providing a piston for gas lubrication between the piston and a cylinder, an improvement is achieved so that the gas lubrication is not disturbed by condensed water.

MODES FOR CARRYING OUT THE INVENTION

Embodiments according to the present invention will be described with reference to drawings.

First Embodiment

Figure 1:
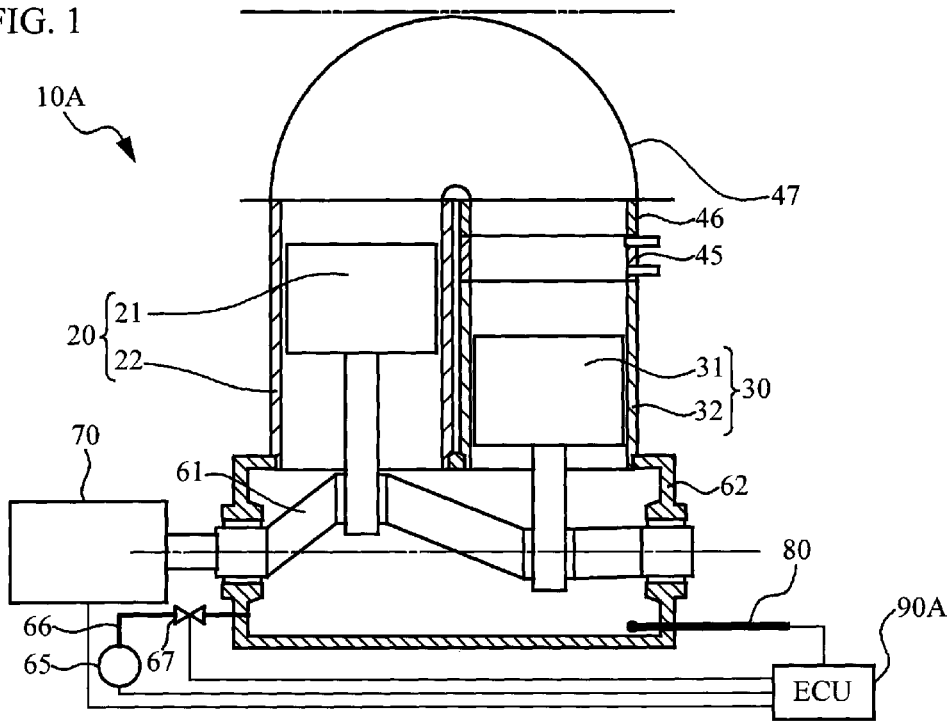
FIG. 1 is a view of a stirling engine according to a first embodiment.

FIG. 1 is a view of a stirling engine 10A. The stirling engine 10A is a multicylinder α type (herein, two cylinders). The stirling engine 10A is provided with a high-temperature-side cylinder 20 and a low-temperature-side cylinder 30 which are linearly and parallel arranged with each other. Also, a cooler 45, a regenerator 46, and a heater 47 are provided. The high-temperature-side cylinder 20 includes an expansion piston 21 and a high-temperature side cylinder 22, and the low-temperature-side cylinder 30 includes a compression piston 31 and a low-temperature side cylinder 32.

A space at the upper side of the high-temperature side cylinder 22 serves as an expansion space. Working fluid heated by the heater 47 circulates into the expansion space. The heater 47 exchanges heat between the circulating working fluid and exhaust gas of the internal combustion engine. Therefore, the working fluid is heated with heat energy collected from the exhaust gas. Herein, in the stirling engine 10A, the exhaust gas of the internal combustion engine serves as a high temperature heat source.

A space at the upper side of the low-temperature side cylinder 32 serves as a compression space. The working fluid cooled by the cooler 45 circulates into the compression space. The cooler 45 cools the working fluid by exchanging heat between the cooler 45 and a coolant as a cooling medium. The regenerator 46 transfers and receives heat to and from the working fluid reciprocating between the expansion and compression spaces. Specifically, the regenerator 46 receives heat from the working fluid when the working fluid circulates from the expansion space to the compression space. The regenerator 46 transfers the stored heat to the working fluid when the working fluid circulates from the compression space to the expansion space. The air is employed as the working fluid. However, the working fluid is not limited to the air. For example, gas such as He, H2, or N2 is applicable to the working fluid.

Next, the operation of the stirling engine 10A will be described. The heater 47 heats the working fluid, so that the working fluid expands to press down the expansion piston 21. Next, when the expansion piston 21 shifts to an upward stroke, the working fluid is fed to the regenerator 46 through the heater 47. The working fluid releases heat in the regenerator 46 and circulates into the cooler 45. The working fluid cooled in the cooler 45 circulates into the compression space, and then is compressed by the upper movement of the compression piston 31. The working fluid which has been compressed in such a way increases its temperature while depriving heat from the regenerator 46, and then circulates into the heater 47. The working fluid is heated and expanded again.

Herein, in the stirling engine 10A, the working fluid reciprocating between the expansion and compression spaces performs the expansion work. Therefore, the cooler 45 cools the working fluid reciprocating between the expansion and compression spaces to cool the working fluid performing the expansion work. The stirling engine 10A is capable of circulating the common coolant to the corresponding internal combustion engine to the cooler 45. As described, the coolant starts circulating to the cooler 45 before the stirling engine 10A starts (for example, at the time when the corresponding internal combustion engine starts).

Incidentally, in the stirling engine 10A, the gas lubrication is performed between the pistons 21 and 31 and the cylinders 22 and 32, respectively. In the gas lubrication, the pistons 21 and 31 are floated in the air by utilizing the air pressure (distribution) generated between the minute clearances between the pistons 21 and 31 and the cylinders 22 and 32, respectively. The sliding resistance of the gas lubrication is very small, thereby significantly reducing the internal friction within the stirling engine 10A. The gas lubrication causing an object to float in the air may employ, for example, specifically, static pressure gas lubrication in which a pressurized fluid is ejected to generate static pressure for floating the object. However, the gas lubrication is not limited to this, and may be dynamic pressure gas lubrication.

The stirling engine 10A further includes a crankshaft 61 and a crankcase 62. The crankshaft 61 converts the reciprocating movements of the pistons 21 and 31 into a rotational movement. The crankshaft 61 provides a phase difference between the pistons 21 and 31. The crankshaft 61 is provided in the crankcase 62. The crankcase 62 houses a crank portion of the crankshaft 61.

The stirling engine 10A further includes a pressure pump 65, a pressure pipe 66, and a pressure opening and closing valve 67. The pressure pump 65 pressurizes the inside of the crankcase 62. Specifically, the pressure pump 65 takes the air from the outside, pressures the air, and supplies the air to the crankcase 62 so as to pressurize the crankcase 62. The pressure pipe 66 connects the crankcase 62 with the pressure pump 65. The pressure opening and closing valve 67 is provided in the pressure pipe 66, and permits or prohibits the pressurization of the inside of the crankcase 62.

In the stirling engine 10A, even when the inside of the crankcase 62 is pressurized, the average pressure force of the working fluid in the expansion and compression spaces is substantially equal to the average pressure force of the working fluid within the crankcase 62 as time advances, through the minute clearances between the pistons 21 and 31 and the cylinders 22 and 32, respectively. For this reason, in the stirling engine 10A, the inside of the crankcase 62 is pressurized to make the working fluid to have high pressure, thereby ensuring the great output.

The stirling engine 10A further includes a starter 70, a hygrometer 80, and an ECU 90A. The starter 70 drives the crankshaft 61 to assist the start of the stirling engine 10A. The hygrometer 80 is provided in the crankcase 62, and measures the humidity within the crankcase 62 (the internal humidity, within the crankcase 62, of the stirling engine 10A). Herein, the crankcase 62 corresponds to a predetermined portion in the stirling engine 10A.

The ECU 90A is an electronic control unit. The ECU 90A is electrically connected to a controlled object such as the starter 70, and sensors or switches such as the pressure pump 65, the pressure opening and closing valve 67, and the hygrometer 80. In the ECU 90A, a CPU processes based on a program stored in a ROM and uses a temporary memory area of a RAM if necessary, so that various function units such as a control unit as will be described below is achieved.

The control unit adjusts the start timing based on the internal humidity of the stirling engine 10A. Herein, the control unit adjusts the start timing based on the humidity within the crankcase 62. The control unit performs the start, when the humidity within the crankcase 62 is lower than a predetermined value α. Thus, in a case where the humidity within the crankcase 62 is higher than the predetermined value α (specifically, the humidity is higher than or equal to the predetermined value α), the start is performed at the time when the humidity is lower than the predetermined value α. Specifically, the control unit drives the starter 70 for performing the start. The stirling engine 10A is provided with the ECU 90A achieving the control unit, thereby performing these control processes.

Figure 2:
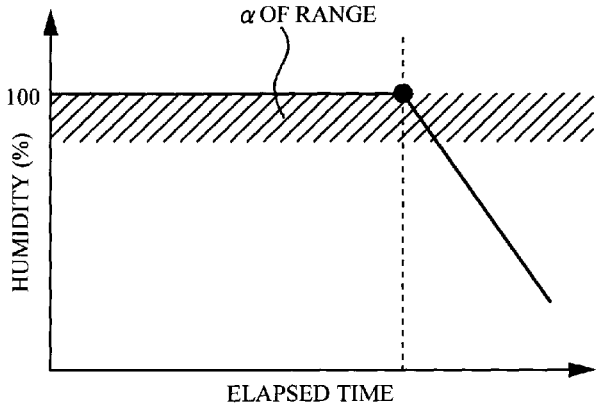
FIG. 2 is an explanatory view of a predetermined value in the first embodiment.

FIG. 2 is an explanatory view of the predetermined value α. The vertical axis indicates a humidity, and the horizontal axis indicates an elapsed time. The humidity indicated by the vertical axis represents the internal humidity, at the cooler 45 through which the coolant circulates, of the stirling engine 10A. As illustrated in FIG. 2, it can be understood that when the humidity is 100 percent before the start is performed, the condensation will occur within the cooler 45. In this case, when the humidity changes to be lower than 100%, it can be understood that the working fluid is heated by the heater 47 as time advances, so that condensation does not occur within the cooler 45.

On the other hand, in the stirling engine 10A, a temperature of the working fluid within the cooler 45, where the temperature of the working fluid has been most reduced, is different from that of the working fluid within the crankcase 62, where the humidity is actually measured by the hygrometer 80. The cooler 45 is also apart from the crankcase 62. For this reason, the predetermined value α can be set smaller than 100 percent by a humidity difference which can occur between them at the time when the humidity within the cooler 45 through which the coolant circulates is lower than 100 percent. Also, the predetermined value α can be set smaller by a measurement error caused by the hygrometer 80 itself.

Next, a description will be given of the control operation of the stirling engine 10A performed by the ECU 90A with reference to a flowchart illustrated in FIG. 3. The ECU 90A measures the humidity (step S1). Next, it is determined whether or not the humidity is in the state where the start can be performed (step S2). In step S2, specifically, it is determined whether or not the measured humidity is lower than the predetermined value α. When a negative determination is made in step S2, the process returns to step S1. A positive determination is made in step S2 afterward, so that the measured humidity is lower than the predetermined value α. When it is a positive determination is made in step S2, the ECU 90A performs the start (step S3). In step S3, specifically, the ECU 90A drives the starter 70. Additionally, the start may be performed in step S3 when another start condition is satisfied (for example, whether or not the stirling engine 10A is capable of driving independently). This flowchart finishes after step S3.

Effects of the stirling engine 10A will be described next. The stirling engine 10A adjusts the start timing based on the humidity within the crankcase 62. It is therefore possible to perform the start in the state where condensation does not occur within the cooler 45 which most reduces the temperature of the working fluid. For this reason, the stirling engine 10A can improve so that the gas lubrication is not disturbed by condensed water. This prevents or suppresses, specifically, an increase in friction and damage of sliding portions.

Specifically, in the stirling engine 10A, the start is performed when the humidity within the crankcase 62 is lower than the predetermined value α. It is thus possible to perform the start in the state where condensation does not occur within the cooler 45.

Moisture contained in the working fluid tends to be condensed, when the inside of the stirling engine 10A is pressured. As a result, the gas lubrication tends to be disturbed by condensed water. Thus, for example, the stirling engine 10A is suitable for pressurizing the inside thereof by pressurizing the inside of the crankcase 62.

In the stirling engine 10A, the air containing moisture serves as the working fluid, resulting in the gas lubrication tends to be disturbed by condensed water. Therefore, the stirling engine 10A is suitable for employing the air as the working fluid. Herein, the stirling engine 10A is suitable for being provided with the pressure pump 65, which takes the air from the outside and pressure supplies the air to the inside so as to pressure the inside, and in addition, moisture contained in the working fluid tends to be condensed when the inside is pressured.

Second Embodiment

Figure 4:
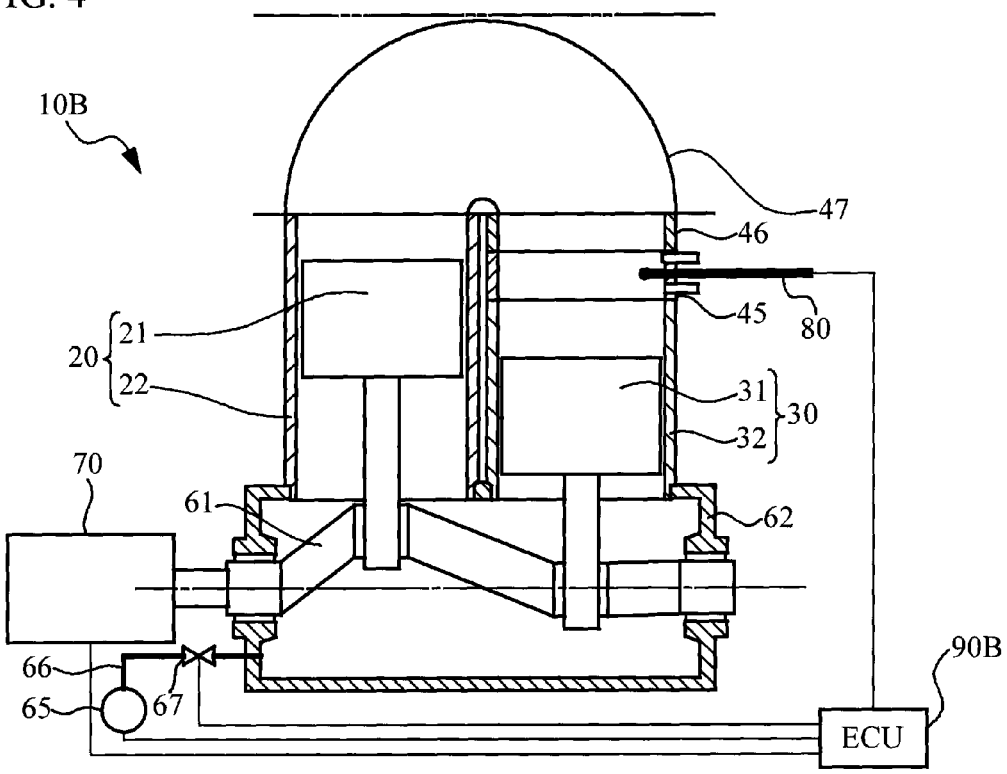
FIG. 4 is a view of a stirling engine according to a second embodiment.

FIG. 4 is a view of a stirling engine 10B. The stirling engine 10B is the substantially the same as the stirling engine 10A, except that the hygrometer 80 is provided in the cooler 45 and an ECU 90B is provided instead of the ECU 90A. In the stirling engine 10B, the hygrometer 80 measures the humidity within the cooler 45 (the internal humidity, at the cooler 45, of the stirling engine 10B). Herein, in the stirling engine 10B, the cooler 45 corresponds to a predetermined portion.

The ECU 90B is substantially the same as the ECU 90A, except that a control unit is achieved as follows. Specifically, in a case where, in the ECU 90B, the control unit adjusts the start timing based on the internal humidity, the start timing is adjusted based on the humidity within the cooler 45. Therefore, the start is performed when the humidity within the cooler 45 is lower than a predetermined value β. In a case where the humidity within the cooler 45 is higher than or equal to the predetermined value β, the start is performed when the humidity is lower than the predetermined value β. For example, the predetermined value β is set to 100 percent. The predetermined value β can be set smaller by a measurement error caused by the hygrometer 80 itself.

Figure 3:
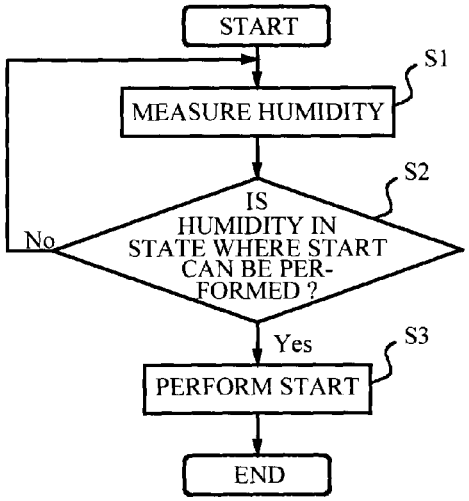
FIG. 3 is a view of control operation in the first embodiment.

Additionally, the control operation of the stirling engine 10B is the same as the control operation of the stirling engine 10A illustrated in FIG. 3. Thus, illustration of a flowchart of the control operation of the stirling engine 10B is omitted. Herein, in the stirling engine 10B, the predetermined value β is applied instead of the predetermined value α, in step S2.

Effects of the stirling engine 10B will be described next. In the stirling engine 10B, the start timing is adjusted based on the humidity in the cooler 45, whereby it can be directly determined whether or not condensation occurs in the cooler 45. Thus, the stirling engine 10B is suitable for performing the start earlier than the stirling engine 10A, because the suitable start timing can be determined with accuracy in order the improvement to be achieved such that the gas lubrication is not disturbed by condensed water.

Third Embodiment

Figure 5:
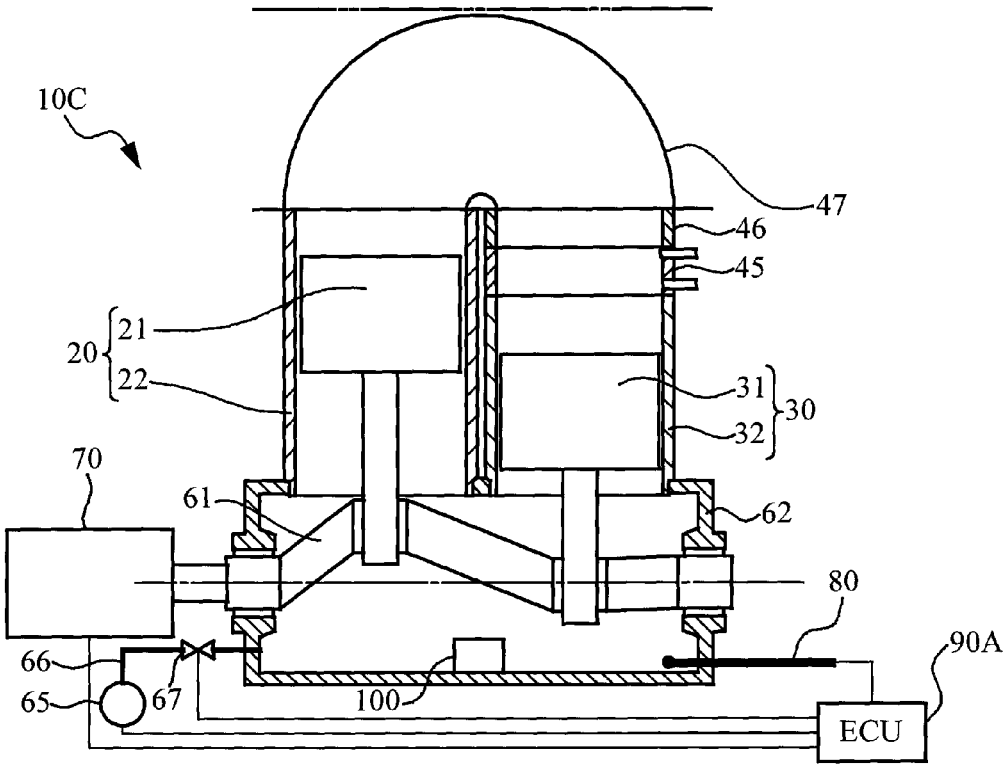
FIG. 5 is a view of a stirling engine according to a third embodiment.

FIG. 5 is a view of a stirling engine 10C. The stirling engine 10C is substantially the same as the stirling engine 10A, except that a cooling portion 100 is further provided. For example, a similar variation is applicable to the stirling engine 10B. The cooling portion 100 is provided within the crankcase 62, and further reduces the temperature of the working fluid as compared with the cooler 45.

Figure 6:
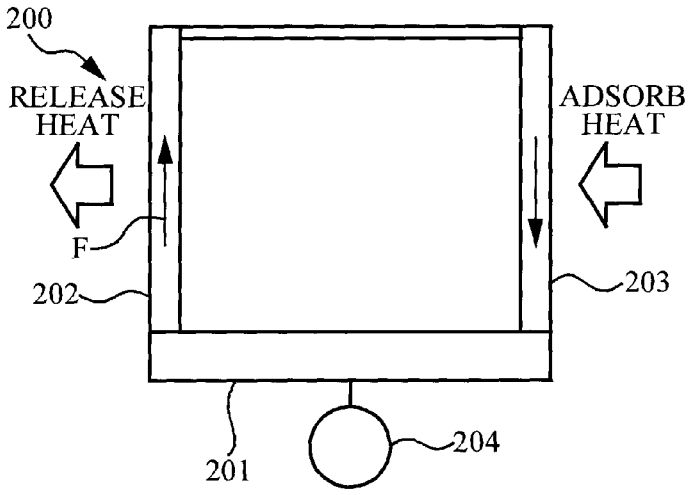
FIG. 6 is a view of a first concrete example of a cooling portion.

FIG. 6 is a view of a first concrete example of the cooling portion 100. A cooling device 200 illustrated in FIG. 6 includes a compressor 201, a condensing portion 202, an evaporating portion 203, and a drive motor 204. The compressor 201 compresses a cooling medium F. The cooling medium F compressed by the compressor 201 condenses in the condensing portion 202 to release heat. For example, the cooling medium F condensed in the condensing portion 202 expands, and then evaporates in the evaporating portion 203 to receive heat. The drive motor 204 drives the compressor 201. Herein, for example, specifically, the cooling portion 100 is achieved by the evaporating portion 203 of the cooling device 200, whereby the cooling portion 100 serves as a cooling portion capable of cooling by use of vaporization heat of the cooling medium F.

Figure 7:
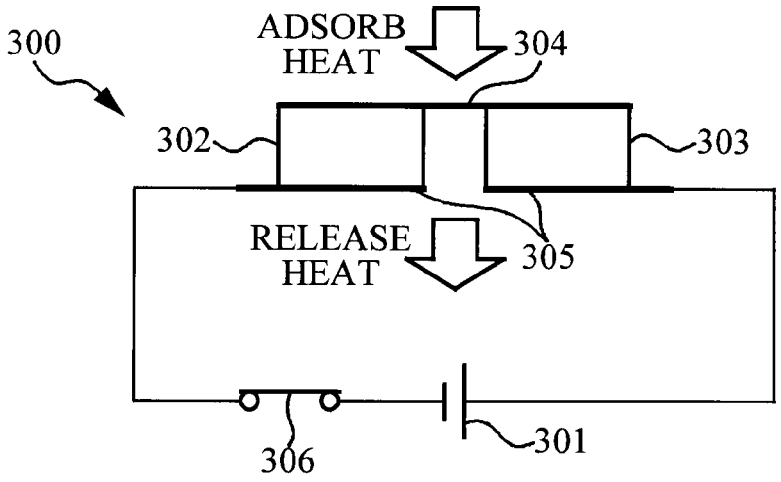
FIG. 7 is a view of a second concrete example of the cooling portion.

FIG. 7 is a view of a second concrete example of the cooling portion 100. A cooling device 300 illustrated in FIG. 7 includes a direct current power supply 301, a p-type semiconductor 302, an n-type semiconductor 303, electrodes 304 and 305, and a switch 306. In the cooling device 300, the semiconductors 302 and 303 joined with the electrode 305 are connected with the direct current power supply 301 through the switch 306. When electric current flows through the semiconductors 302 and 303, heat is adsorbed at one side of the electrodes (herein, the electrode 304 side) and heat is generated at the other side of the electrodes (herein, the electrode 305 side), that is, Peltier effect occurs.

Herein, for example, specifically, the cooling portion 100 is achieved by a semiconductor unit including the semiconductors 302 and 303 and the electrodes 305 and 306 of the cooling device 300, whereby the cooling portion 100 serves as a cooling portion capable of cooling by use of the heat adsorption of Peltier effect.

The cooling portion 100 causes condensation to occur so as to reduce moisture contained in the working fluid. This brings dehumidification effect. Thus, the cooling portion 100 also corresponds to a dehumidifying portion. On the other hand, the dehumidifying portion which reduce the internal humidity of the stirling engine 10C is not limited to the cooling portion 100. For example, a dehumidifier which can dehumidify by use of a dehumidifying agent may be provided within the crankcase 62. Herein, for example, the dehumidifying portion may be provided within the pressure pipe 66 to dehumidify the air introduced into the stirling engine 10C. For example, such a dehumidifying portion may be achieved by a dehumidifier which can dehumidify by use of a dehumidifying agent.

Figure 8:
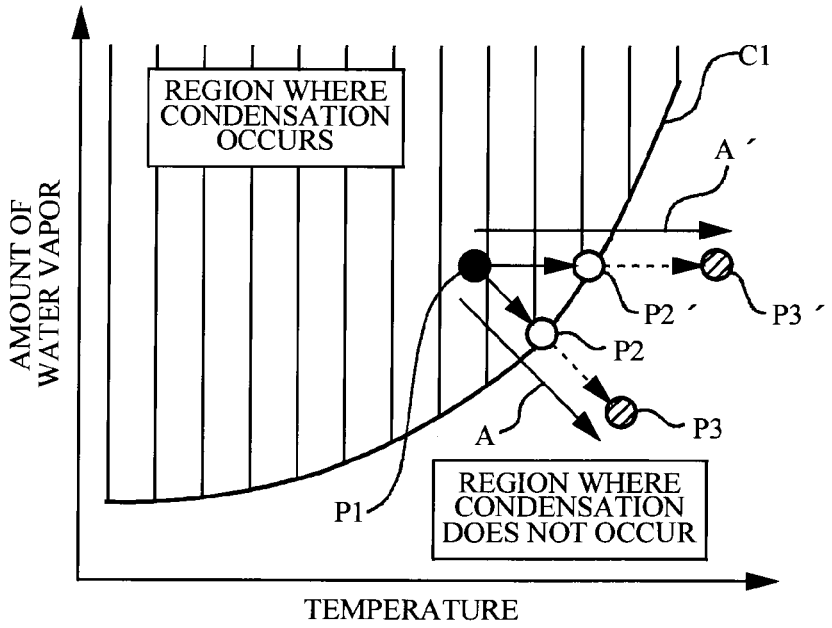
FIG. 8 is an explanatory view of a change in state at the time of an engine warming-up.

Effects of the stirling engine 10C will be described next. FIG. 8 is an explanatory view of a change in state at the time of the engine warming-up. The vertical axis indicates an amount of water vapor, and the horizontal axis indicates time. A pattern A corresponds to the stirling engine 10C. A pattern A' corresponds to a case where the cooling portion 100 does not cool. A point P1 indicates a predetermined amount of the water vapor included in the working fluid after the warming up, by corresponding the amount of the water vapor corresponding to a cooling temperature of the cooler 45. Points P2 and P2' indicates positions where condensation disappears. Points P3 and P3' indicates positions where the warming up finishes. A curve C1 is a saturated vapor curve.

The stirling engine 10C is provided with the cooling portion 100 within the crankcase 62 so as to cause condensation to occur in the cooling portion 100. Thus such dehumidification accelerates a reduction in humidity within the cooler 45. This can make the temperature when condensation disappears in the pattern A lower than that in the pattern A'. Thus, the stirling engine 10C is suitable for performing the start early, because accelerating a reduction in humidity within the cooler 45 as compared with the stirling engine 10A.

Figure 9:
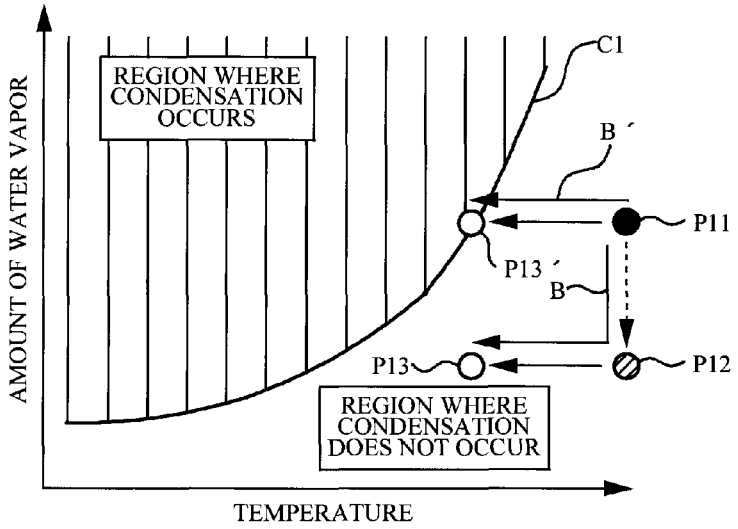
FIG. 9 is an explanatory view of a change in state at the time when a cooler starts cooling.

In a case where the coolant starts circulating through the cooler 45 at the time when the start is performed, the stirling engine 10C can prevent condensation from occurring as will be described below. FIG. 9 is an explanatory view of a change in state at the time when the cooler 45 starts cooling. The vertical axis indicates an amount of water vapor. The horizontal axis indicates time. A pattern B corresponds to the stirling engine 10C. A pattern B' corresponds to a case where the cooling portion 100 does not cool. A point P11 indicates a position before the start is performed. A point P12 indicates a position where an amount of water vapor is reduced in a case where the cooling portion 100 cools, while corresponding to the point P11. Points P13 and P13' indicates positions when the start is performed. A curve C1 is a saturated vapor curve.

In a case where the coolant starts circulating through the cooler 45 at the time when the start is performed, the cooling is performed in the cooling portion 100 by the stirling engine 10C before the start is performed, whereby it is possible to reduce the humidity within the cooler 45. This reduces the amount of the water vapor in the pattern B to be smaller than that in the pattern B'. Therefore, even when the temperature of the working fluid is reduced at the time when the cooler 45 starts cooling, condensation can be prevented from occurring in the cooler 45. Thus, in a case the coolant starts circulating through the cooler 45 at the same time of starting the stirling engine 10C, the occurrence of the condensation in the cooler 45 itself can be prevented.

Fourth Embodiment

Figure 10:
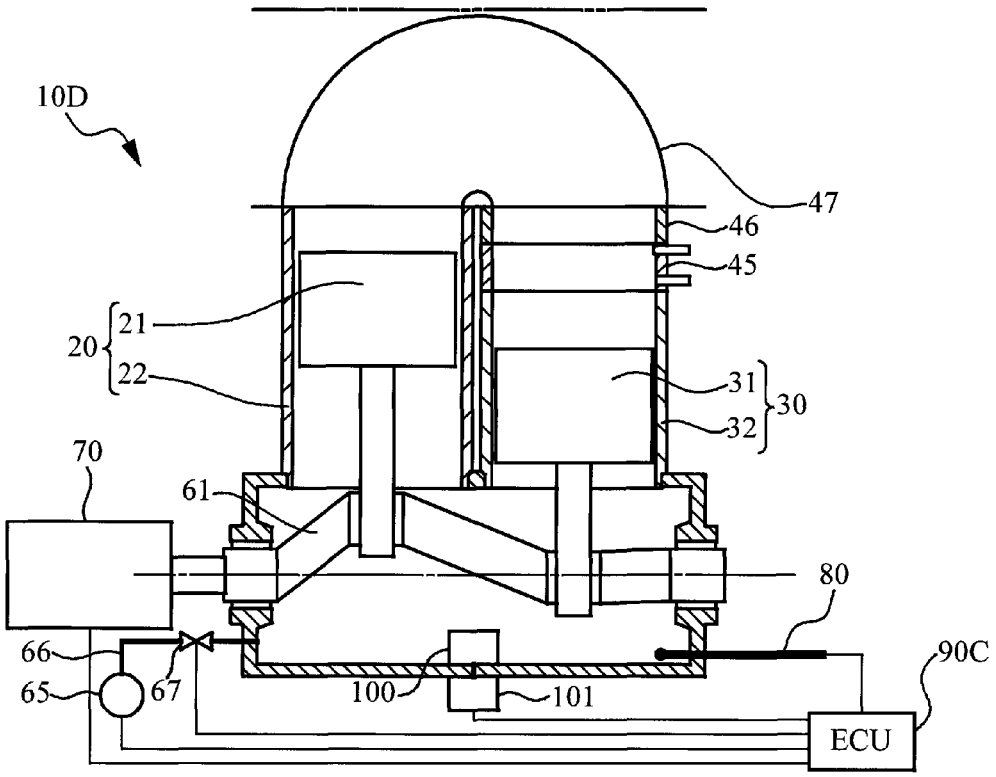
FIG. 10 is a view of a stirling engine according to a fourth embodiment.

FIG. 10 is a view of a stirling engine 10D. The stirling engine 10D is substantially the same as the stirling engine 10C, except that an operation control portion 101 controls the operation of the cooling portion 100 is provided, and an ECU 90C is provided instead of the ECU 90A. The ECU 90C is substantially the same as the ECU 90A, except that the operation control portion 101 is electrically connected with the ECU 90C, and the control unit is achieved below. In addition, for example, a similar variation is applicable to the stirling engine 10B which is further provided with the cooling portion 100.

In the ECU 90C, the control unit is achieved to operate the cooling portion 100 based on the humidity within the crankcase 62. Specifically, when the humidity within the crankcase 62 is higher than the predetermined value $\alpha$ (specifically, is equal to or higher than the predetermined value $\alpha$), the control unit operates the cooling portion 100. Also, when the humidity within the crankcase 62 is lower than the predetermined value $\alpha$, the cooling portion 100 stops. Additionally, in a case where a similar variation is applied to the stirling engine 10B which is further provided with the cooling portion 100, the humidity within the crankcase 62 corresponds to the humidity within the cooler 45, and the predetermined value $\alpha$ corresponds to the predetermined value $\beta$.

The control unit operates the cooling portion 100 by controlling the operation control portion 101. Herein, for example, specifically, the operation control portion 101 is achieved below. Specifically, in a case where the cooling portion 100 corresponds to the evaporating portion 203, the operation control portion 101 can be achieved by the drive motor 204. Also, in a case where the cooling portion 100 is achieved by the semiconductor unit, for example, including the semiconductors 302 and 303, and the electrodes 304 and 305, the operation control portion 101 can be achieved by the switch 306.

Figure 11:
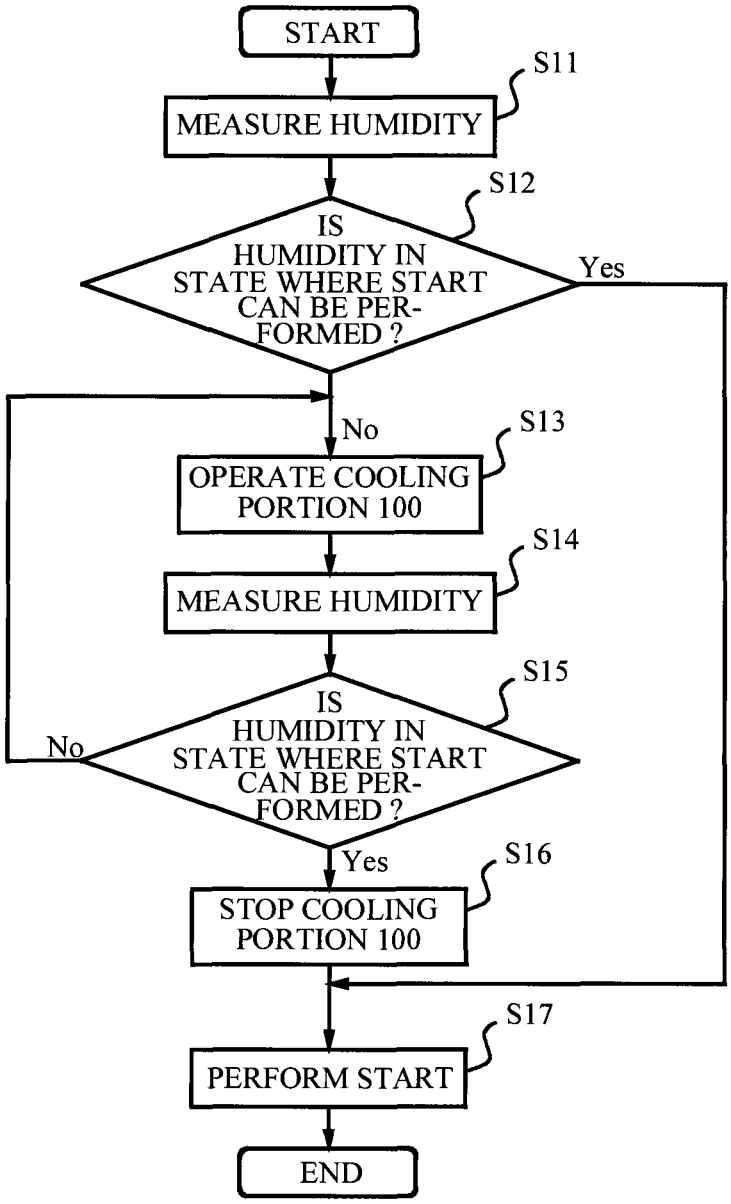
FIG. 11 is a view of control operation in the fourth embodiment.

Next, a description will be given of the control operation of the stirling engine 10D performed by the ECU 90C with reference to a flowchart illustrated in FIG. 11. The ECU 90C measures the humidity (step S11), and determines whether or not the humidity is in the state where the start can be performed (step S12). If a negative determination is made in step S12, the ECU 90C operates the cooling portion 100 (step S13). Subsequently, the ECU 90C measures the humidity (step S14), and determines whether or not the measured humidity is in the state where the start can be performed (step S15). Additionally, in steps S12 and S15, specifically, it is determined whether or not the measured humidity is lower than the predetermined value α.

If a negative determination is made in step S15, the process returns to step S13. Thus, until the measured humidity is smaller than the predetermined value α, the operation of the cooling portion 100 continues. On the other hand, if a positive determination is made in step S15, the ECU 90C stops the operation of the cooling portion 100 (step S16). Subsequently, the start is performed (step S17), after step S16, or after a positive determination is made in step S12. Additionally, the start may be performed in step S17, when another start condition is satisfied. This flowchart finishes after step S17.

Effects of the stirling engine 10D will be described next. In the stirling engine 10D, the cooling portion 100 is operated based on the humidity within the crankcase 62, whereby the cooling portion 100 can be operated in the range where dehumidification is effective for making start timing early. This can also suppress waste of energy used for the operation of the cooling portion 100.

In the stirling engine 10D, specifically, when the humidity within the crankcase 62 is higher than the predetermined value α, the cooling portion 100 operates, and when the humidity within the crankcase 62 is lower than the predetermined value α, the cooling portion 100 stops. It is therefore possible to operate the cooling portion 100 in the range where dehumidification is effective for making the start timing early.

Fifth Embodiment

Figure 12:
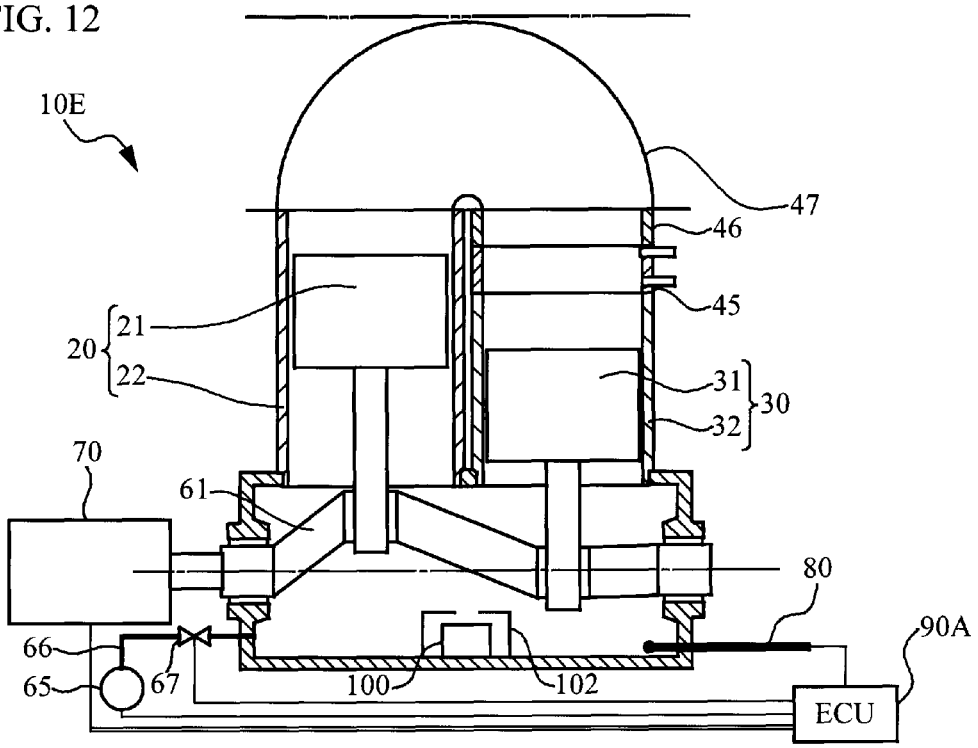
FIG. 12 is a view of a stirling engine according to a fifth embodiment.

FIG. 12 is a view of a stirling engine 10E. The stirling engine 10E is substantially the same as the stirling engine 10C, except that a partition wall portion 102 is further provided around the cooling portion 100 within the crankcase 62. For example, a similar variation is applicable to the stirling engine 10D or the stirling engine 10B which is further provided with the cooling portion 100. The partition wall portion 102 is provided with a ventilation portion around the cooling portion 100 in such a manner that the air can blow into the cooling portion 100. For example, the partition wall portion 102 may be formed as a part of the crankcase 62.

Effects of the stirling engine 10E will be described next. In the stirling engine 10E, the provision of the partition wall portion 102 can prevent or suppress water condensed in the cooling portion 100 from being scattered by vibration or the like and infiltrating between the piston 21 and the cylinder 22 or between the piston 31 and the cylinder 32. Thus, this stirling engine 10E improves such that the gas lubrication is not disturbed by condensed water in a highly suitable manner, as compared with the stirling engine 10C.

Sixth Embodiment

Figure 13:
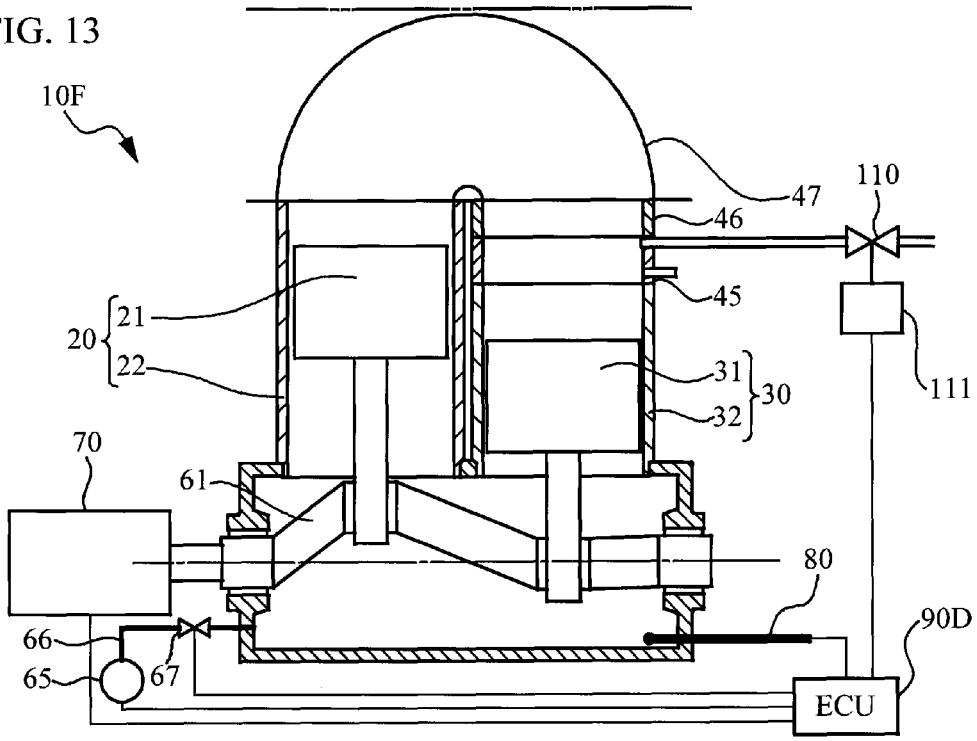
FIG. 13 is a view of a stirling engine according to a sixth embodiment.

FIG. 13 is a view of a stirling engine 10F. The stirling engine 10F is substantially the same as the stirling engine 10A, except that a control valve 110 which is capable of controlling the supply of the coolant to the cooler 45 is provided, an actuator 111 for the control valve 110 is provided, and an ECU 90D is provided instead of the ECU 90A. The ECU 90D is substantially the same as the ECU 90A, except that the actuator 111 as an controlled object is electrically connected to the ECU 90D, and the control unit is achieved as follows. For example, a similar variation is applicable to the stirling engines 10B, 10C, 10D and 10E.

In the ECU 90D, the control unit is achieved to control the control valve 110 to restricts the circulation of the coolant before the start (herein, specifically, the control valve 110 is closed). In this regard, in the control valve 110, unless the control unit controls the control valve 110 to restrict the circulation of the coolant before the start, the control valve 110 remains in a state of releasing the restriction of the circulation of the coolant before the start (specifically, the valve is in an open state). This releases the restriction of the circulation of the coolant to the cooler 45 before the start. That is, herein, specifically, the coolant starts circulating to the cooler 45 before the start.

Specifically, when the humidity within the crankcase 62 is higher than the predetermined value α (specifically, the humidity is equal to or higher than the predetermined value α), the control unit controls the control valve 110 to restrict the circulation of the coolant, thereby controlling the control valve 110 to restrict the circulation of the coolant before the start. On the other hand, when the humidity within the crankcase 62 is lower than the predetermined value α, the control unit controls the control valve 110 to release the restriction of the circulation of the coolant (specifically, herein, the control valve 110 opens). The control unit controls the actuator 111 to the control valve 110. Additionally, in a case where a similar variation is applied to the stirling engine 10B, the humidity within the crankcase 62 corresponds to the humidity within the cooler 45, and the predetermined value α corresponds to the predetermined value β.

Figure 14:
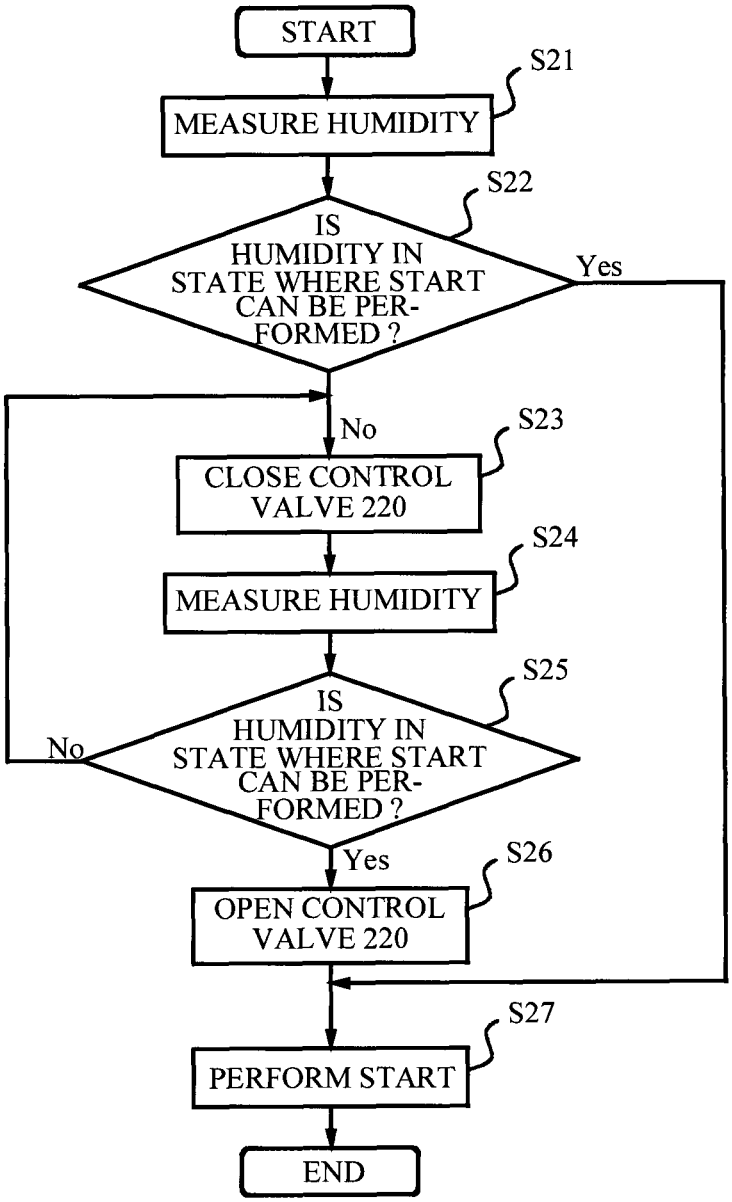
FIG. 14 is a view of control operation in the sixth embodiment.

Next, a description will be given of the control operation of the stirling engine 10F performed by the ECU 90D with reference to a flowchart illustrated in FIG. 14. The ECU 90D measures the humidity (step S21), and determines whether or not the humidity is in a state where the start can be performed (step S22). If a negative determination is made in step S22, the ECU 90D controls the control valve 110 to close (step S23). Subsequently, the ECU 90D measures the humidity (step S24), and determines whether or not the humidity is in the state where the start can be performed (step S25). Additionally, specifically, it is determined whether or not the measured humidity is lower than predetermined value α in steps S22 and S25.

If a negative determination is made in step S25, the process returns to step S23. Thus, until the measured humidity is lower than the predetermined value α, the control valve 110 continues closing. On the other hand, if a positive determination is made in step S25, the ECU 90D controls the control valve 110 to open (step S26). Subsequently, the ECU 90D performs the start (step S27), after step S26, or after a positive determination is made in step S22. Also, the start may be performed in step S27, when another start condition is satisfied. This flowchart finishes after step S27.

Effects of the stirling engine 10F will be described next. In the stirling engine 10F, the control valve 110 is controlled to restrict the circulation of the coolant before the start, thereby reducing the cooling ability of the cooler 45. This accelerates the warming up to reduce the humidity within the cooler 45 early. Thus, this stirling engine 10F is suitable for making the start timing early, because accelerating a reduction in humidity in the cooler 45 as compared with the stirling engine 10A.

In the stirling engine 10F, specifically, when the humidity within the crankcase 62 is higher than the predetermined value α, the control valve 110 is controlled to restrict the circulation of the coolant, and when the humidity within the crankcase 62 is lower than the predetermined value α, the control valve 110 is controlled to release the restriction of the circulation of the coolant. It is therefore possible to reduce the cooling ability of the cooler 45 in the range where making the start timing early is effective in terms of condensation.

Seventh Embodiment

Figure 15:
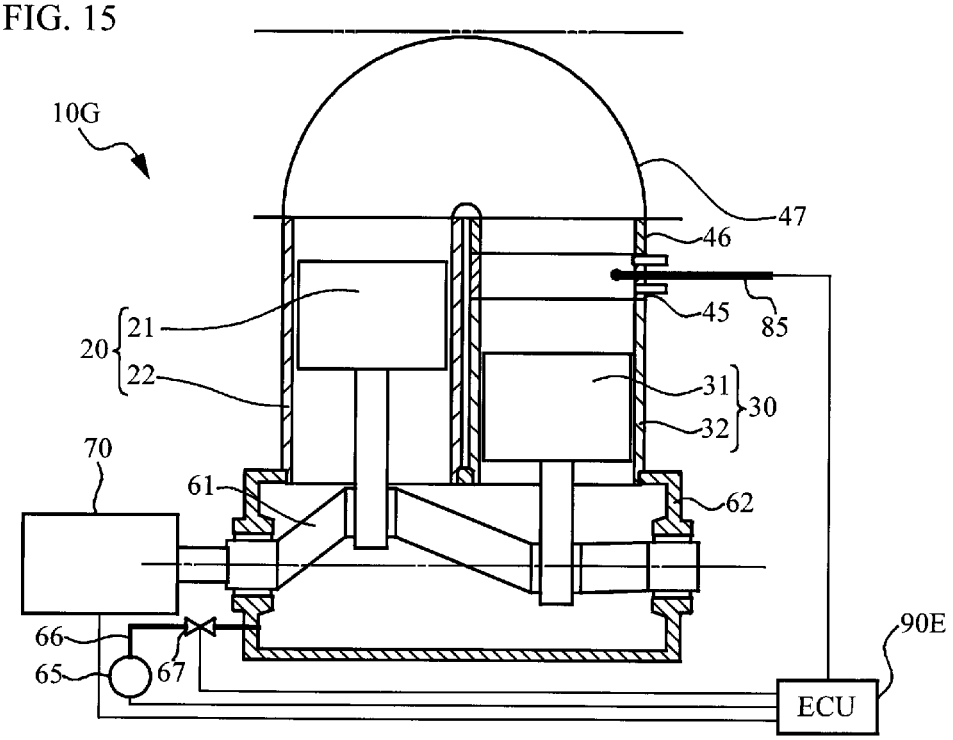
FIG. 15 is a view of a stirling engine according to a seventh embodiment.

FIG. 15 is a view of a stirling engine 10G. The stirling engine 10G is substantially the same as the stirling engine 10A, except that a thermometer 85 is provided instead of the hygrometer 80, an ECU 90E is provided instead of the ECU 90A. The ECU 90E is substantially the same as the ECU 90A, except that the thermometer 85 instead of the hygrometer 80 is electrically connected to the ECU 90E, and the control unit is achieved as follows. A similar variation is applicable to the stirling engines 10C, 10D, 10E and 10F.

The thermometer 85 is provided in the cooler 45. The thermometer 85 detects the temperature of the working fluid in the cooler 45. In a case where the ECU 90E adjusts the start timing based on the internal humidity, the control unit adjusts the start timing based on the temperature of the working fluid in the cooler 45. Spherically, when the temperature of the working fluid in the cooler 45 is higher than a predetermined value γ, the control unit performs the start. The predetermined value γ is a desired temperature, and is set to the boiling point of the coolant.

Figure 16:
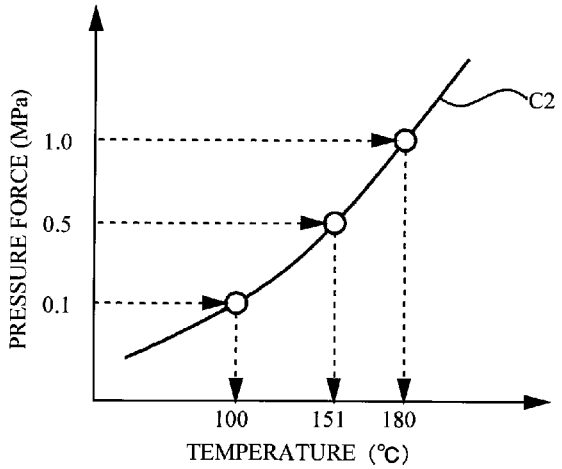
FIG. 16 is a view of a predetermined valve in the seventh embodiment.

FIG. 16 is an explanatory view of the predetermined value γ. The vertical axis indicates a pressure force, and the horizontal axis indicates a temperature. A curve C2 is a saturated vapor curve. Each temperature on the horizontal axis indicates the boiling points. The boiling point changes along the curve C2 with the pressure force as illustrated in FIG. 16. In response to this, the predetermined valve γ is set under the conditions under which the internal pressure is constant in the stirling engine 10G. For example, the predetermined value γ may be a variable value in accordance with the internal pressure of the stirling engine 10G. For example, a pressure sensor can detect the internal pressure of the stirling engine 10G.

Figure 17:
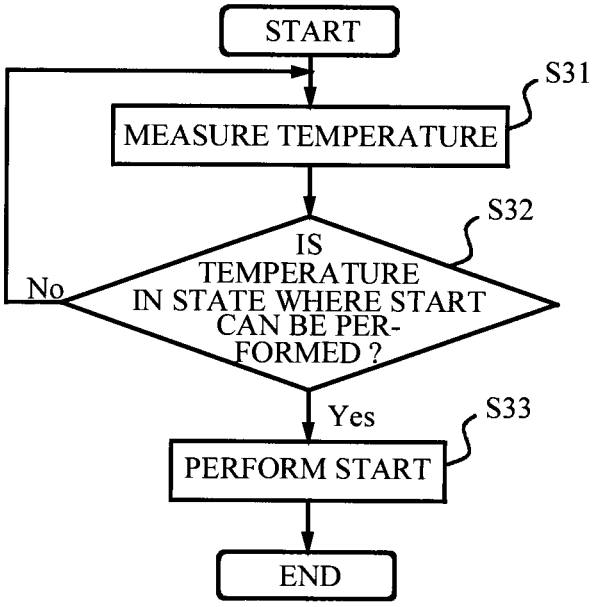
FIG. 17 is a view of control operation in the seventh embodiment.

Next, a description will be given of the control operation of the stirling engine 10G performed by the ECU 90E with reference to a flowchart illustrated in FIG. 17. The ECU 90E measures the temperature of the working fluid in the cooler 45 (step S31), and determines whether or not the temperature is in the state where the start can be performed (step S32). Specifically, it is determined whether or not the measured temperature is higher than the predetermined value γ in step S32. If a negative determination is made in step S32, the process returns to step S31. If a positive determination is made in step S32, the ECU 90E performs the start (step S33). Additionally, in step S33, the start may be performed when another start condition is satisfied. This flowchart finishes after step S33.

Effects of the stirling engine 10G will be described next. The stirling engine 10G adjusts the start timing based on the temperature of the working fluid in the cooler 45. Specifically, the start is performed when the temperature of the working fluid in the cooler 45 is higher than the predetermined value γ, and the predetermined value γ is set to the boiling point of the coolant. Therefore, in a case where the stirling engine 10G adjusts the start timing based on the internal humidity, it is possible to perform the start in the state where condensation does not occur, even when the internal humidity in a predetermined portion is not detected especially. As a result, the improvement is achieved so that the gas lubrication is not disturbed by condensed water.

Eighth Embodiment

Figure 18:
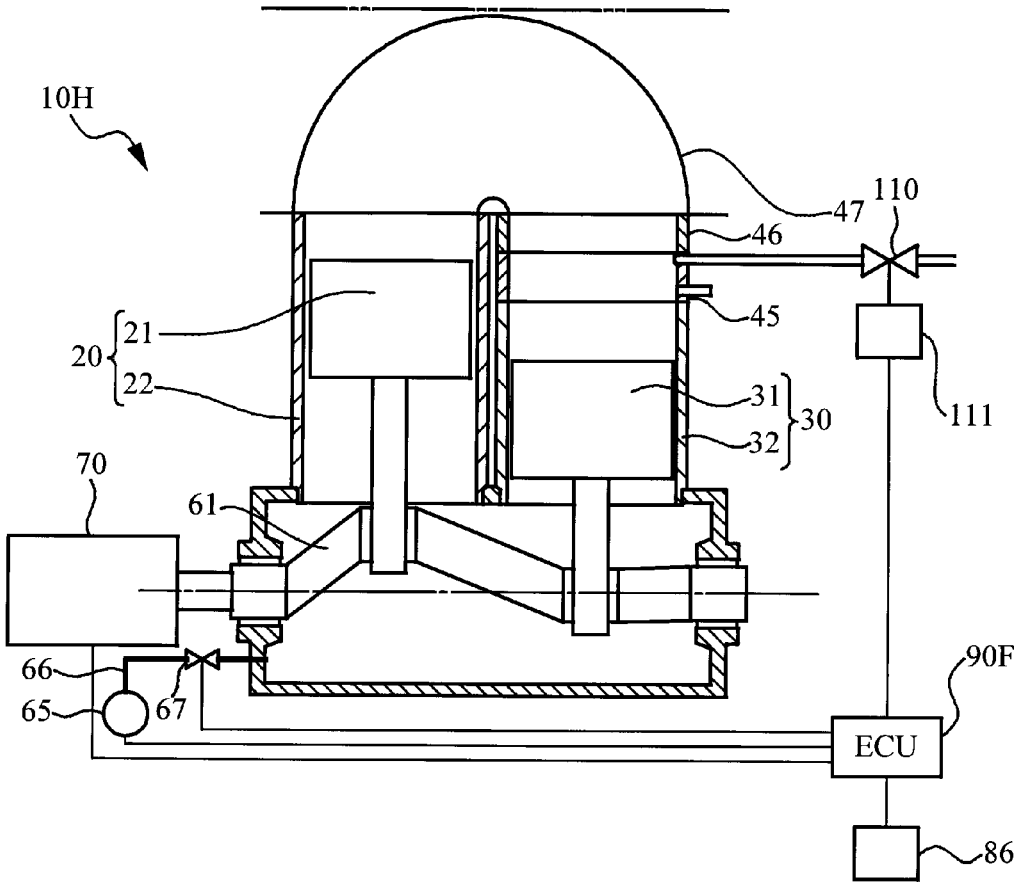
FIG. 18 is a view of a stirling engine according to an eighth embodiment.

FIG. 18 is a view of a stirling engine 10H. The stirling engine 10H is substantially the same as the stirling engine 10F, except that the hygrometer 80 is not especially provided, and an ECU 90F is provided instead of the ECU 90D. The ECU 90F is substantially the same as the ECU 90D, except that a detector 86 instead of the hygrometer 80 is electrically connected, and the control unit is achieved as follows. For example, a similar variation is applicable to the stirling engine 10C, 10D, and 10E which are further provided with the control valve 110 and the actuator 111 if necessary.

The detector 86 is configured to include sensors and switches for detecting the driving state of the corresponding internal combustion engine. For example, the detector 86 includes an airflow meter for measuring an intake air amount of the internal combustion engine, a crank angle sensor for detecting a rotational speed of the internal combustion engine, an acceleration opening sensor for detecting an operation amount of an accelerate pedal (an acceleration opening) used for accelerating the internal combustion engine, and an ignition switch for starting the internal combustion engine. The ECU 90F can detects the start timing and a fuel injection amount (an opening period of a fuel injection valve) of the corresponding internal combustion engine based on the outputs from the detector 86. Herein, for example, the ECU 90F may intercommunicate with an ECU, instead of the detector 86, for controlling the internal combustion engine. Also, the ECU 90F may be for controlling the internal combustion engine.

In a case where the ECU 90F adjusts the start timing based on the internal humidity, the control unit adjusts the start timing based on a heat receiving period. In a case where the start timing is adjusted based on the heat receiving period, the control unit performs the start at the time when the heat receiving period is longer than a predetermined period T. The predetermined period T is set a period when the temperature of the working fluid in the cooler 45 is higher than the predetermined value γ. The predetermined period T is calculated (estimated) to be set as follows.

Specifically, the control unit calculates and integrates the exhaust heat capacity of the corresponding internal combustion engine. Subsequently, a temperature increasing rate of the working fluid is calculated based on an integrated value of the exhaust heat and the heat capacity of the striling engine 10H (whole heat capacity of heat receiving portions including the working fluid in consideration of a heat exchange ability of the heater 47 and heat received in another than the working fluid which transfers heat). Further, the predetermined period T is calculated based on the calculated temperature increasing rate and the predetermined value γ as the desired temperature. Whenever the control unit calculates the integrated value of the exhaust heat capacity, the predetermined valve T is calculated to be updated.

For example, specifically, the exhaust heat capacity can be calculated based on the intake air amount and the fuel injection amount of the corresponding internal combustion engine. Specifically, the temperature increasing rate can be calculated by dividing the heat capacity of the stirling engine 10H by the exhaust heat capacity. Also, the predetermined period T can be calculated by dividing the predetermined value γ by the temperature increasing rate. In a case where the predetermined period T is calculated in such a way, the control unit controls the control valve 110 to close when the corresponding internal combustion engine starts at the latest, and controls the control valve 110 to open when the stirling engine 10H starts.

Figure 19:
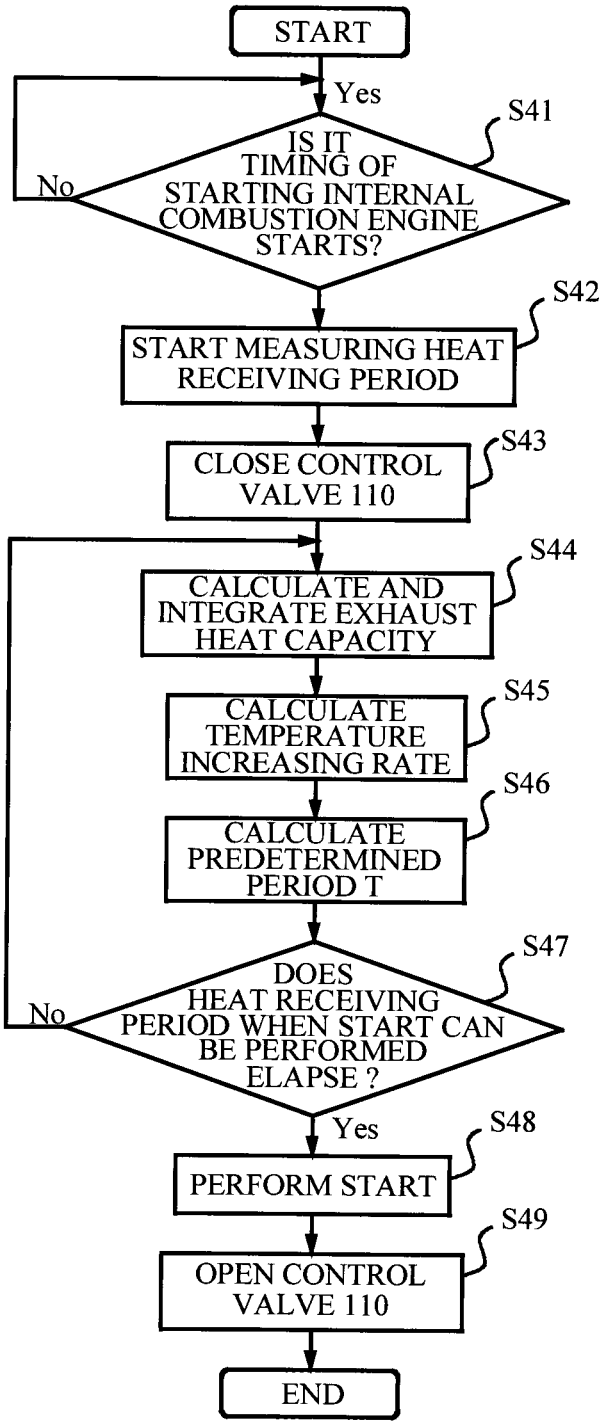
FIG. 19 is a view of control operation in the eighth embodiment.

Next, a description will be given of the control operation of the stirling engine 10H performed by the ECU 90F with reference to a flowchart illustrated in FIG. 19. The ECU 90F determines whether or not the corresponding internal combustion engine starts (step S41). If a negative determination is made, the process returns to step S41. If a positive determination is made, the ECU 90F starts measuring the heat receiving period (step S42). Also, the control valve 110 closes (step S43). Subsequently, the ECU 90F calculates and integrates the exhaust heat capacity (step S44). Further, the temperature increasing rate of the working fluid is calculated (step S45).

Subsequently, the ECU 90F calculates the predetermined period T (step S46), and determines whether or not the heat receiving period when the start can be performed elapses (step S47). Specifically, in step S47, it is determined whether or not the heat receiving period is longer than the predetermined period T. If a negative determination is made in step S47, the process returns to step S44. Therefore, until a positive determination is made in step S47, whenever the integrated value of the exhaust heat capacity is calculated in step S44, the new predetermined period T is calculated in step S46. As a result, the predetermined period T is updated. If a positive determination is made in step S47, the ECU 90F performs the start (step S48). Also, the control valve 110 opens (step S49). Additionally, the start may be performed when another start condition is formed in step S48. This flowchart finishes after step S49.

Effects of the stirling engine 10H will be described next. The stirling engine 10H adjusts the start timing based on the heat receiving period. Specifically, the start is performed when the heat receiving period is longer than the predetermined period T, and the predetermined period T is set to a period when the temperature of the working fluid in the cooler 45 is higher than the predetermined value γ. Therefore, in a case where the stirling engine 10H adjusts the start timing based on the internal humidity, the start can be performed in the state where the condensation does not occur in the cooler 45 without detecting the internal humidity in the predetermined portion. Accordingly, the improvement is achieved so that the gas lubrication is not disturbed by condensed water.

In the stirling engine 10H, the control valve 110 closes at the latest time of the start of the corresponding internal combustion, thereby stopping the cooling of the cooler 45. This accelerates the warming up to make the start timing early. Additionally, in a case where the start timing is adjusted based on the heat receiving period, the coolant may circulate through the cooler 45 in the stirling engine 10H. In this case, the predetermined period T is calculated in consideration of the cool by the cooler 45.

Figure 20:
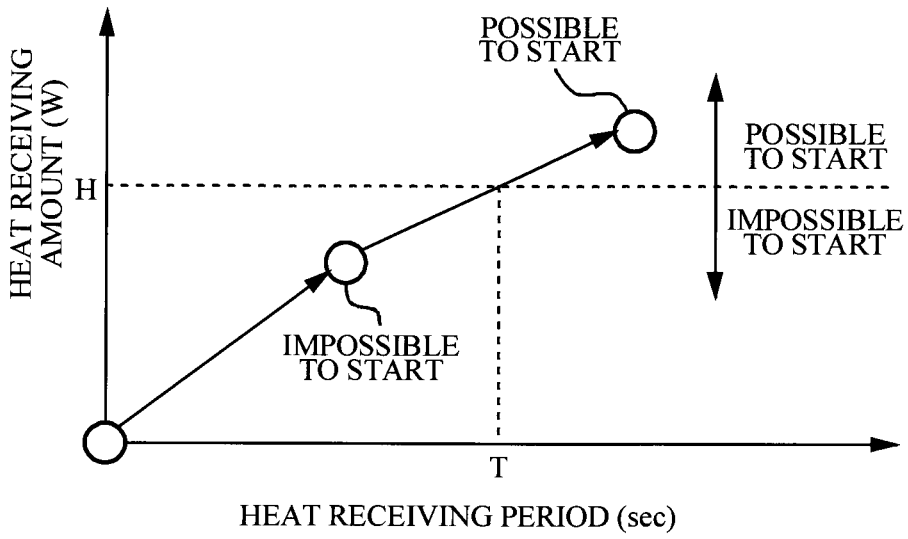
FIG. 20 is a view of a relationship between a heat receiving period and a heat receiving amount.

FIG. 20 is a view of a relationship between the heat receiving period and the heat receiving amount. The vertical axis indicates a heat receiving amount, and the horizontal axis indicates a heat receiving period. As illustrated in FIG. 20, the heat receiving period is longer than the predetermined period T, and then the heat receiving amount is higher than the desired heat amount H, whereby it is possible to start the stirling engine 10H. Herein, in a case where the stirling engine 10H adjusts the start timing based on the internal humidity, the start timing may be adjusted based on the heat receiving amount. In this case, the start is performed when the heat receiving amount is higher than the desired heat amount H as a predetermined amount, and such a predetermined amount can be set to an amount (heat receiving amount corresponding to the predetermined period T) where the temperature of the working fluid in the cooler 45 is higher than the predetermined value γ.

While the exemplary embodiments of the present invention have been illustrated in detail, the present invention is not limited to the above-mentioned embodiments, and other embodiments, variations and modifications may be made without departing from the scope of the present invention.

For example, the stirling engine is not always limited to the internal combustion engine, and may collect heat released from an arbitrary configuration such as a gas turbine. Also, the predetermined portion is not always limited to the crankcase or the cooler. Herein, in a case where the predetermined portion is the crankcase, it is suitable for, for example, setting the hygrometer therein with ease. On the other hand, in a case where the predetermined portion is the cooler, it is suitable for directly determining whether or not the cooler is in the state where condensation occurs therein.

DESCRIPTION OF LETTERS OR NUMERALS stirling engine 10A, 10B, 10C, 10D, 10E, 10F, 10G, 10H
expansion piston 21
high-temperature cylinder 22
compression piston 31
compression cylinder 32
cooler 45
crankshaft 61
crankcase 62
pressure pump 65
starter 70
hygrometer 80
ECU 90A, 90B, 90C, 90D, 90E, 90F
cooling portion 100

The invention claimed is:

1. A stirling engine comprising:
a cylinder;
a piston, gas lubrication being performed between the cylinder and the piston;
a crankcase that is provided with a crankshaft converting a reciprocating movement of the piston into a rotational movement;
a cooler that cools a working fluid performing expansion work;
a hygrometer configured to measure an internal humidity in a predetermined portion of the stirling engine; and
a control unit configured to adjust a start timing of driving a starter coupled with the crankshaft on the basis of the internal humidity.

2. The stirling engine of claim 1, wherein the control unit adjusts the start timing to drive the starter for performing the start of the engine when the control unit determines that the internal humidity in the predetermined portion measured by the hygrometer is lower than a predetermined value.

3. The stirling engine of claim 1, further comprising a dehumidifying portion that reduces the internal humidity.

4. The stirling engine of claim 1, further comprising a cooling portion that is capable of reducing a temperature of the working fluid to be lower than a temperature of the working fluid cooled by the cooler, and that is provided within the crankcase.

5. The stirling engine of claim 4, wherein the cooling portion operates based on the internal humidity, and wherein the internal humidity is a humidity within the crankcase.

6. The stirling engine of claim 4, further comprising a partition wall portion provided around the cooling portion within the crankcase.

7. The stirling engine of claim 1, wherein the cooler cools the working fluid due to exchange of heat with a cooling medium, a control valve is further provided, wherein the control valve is capable of controlling supply of the cooling medium to the cooler, and the control unit controls the control valve to restrict circulation of the cooling medium before start of the engine.

* * * * *